United States Patent [19]

Morris

[11] 3,999,233

[45] Dec. 28, 1976

[54] DUST RUFFLE

[76] Inventor: Mary Morris, 4617 Norfolk Island Pine Drive, Tamarac, Fort Lauderdale, Fla. 33313

[22] Filed: Sept. 23, 1975

[21] Appl. No.: 615,985

[52] U.S. Cl. ..... 5/333; 5/334 C

[51] Int. Cl.[2] ..... A47C 21/00

[58] Field of Search ..... 5/334 R, 334 B, 334 C, 5/333, 335

[56] References Cited

UNITED STATES PATENTS

| | | | |
|---|---|---|---|
| 1,687,580 | 10/1928 | Melcer | 5/334 R |
| 1,867,425 | 7/1932 | Swetzel | 5/334 C |
| 2,139,980 | 12/1938 | Simon | 5/334 R |
| 2,637,860 | 5/1953 | Lehigh | 5/334 R |
| 2,942,280 | 6/1960 | May | 5/334 C |
| 3,621,498 | 11/1971 | Cooper | 5/334 C |
| 3,636,575 | 1/1972 | Smith | 5/335 |
| 3,694,832 | 10/1972 | Jamison | 5/334 C |
| 3,739,408 | 6/1973 | Pagels | 5/334 C |
| 3,858,256 | 1/1975 | Beer | 5/334 C |

*Primary Examiner*—Paul R. Gilliam
*Assistant Examiner*—Andrew M. Calvert
*Attorney, Agent, or Firm*—Anthony J. Casella

[57] ABSTRACT

A dust ruffle is adapted to be positioned between the upper mattress and the lower box spring mattress of a bed, and covers only a portion of the upper plan platform of the lower mattress. Secured to the elastic partial platform portion is a continuous side portion adapted to cover the sides of the lower mattress, and in turn, depending from said continuous side portion is the dust ruffle portion. Since the partial platform portion is made of elastic material, it may readily be expanded so as to slip over the upper mattress in order to position the dust ruffle on the bed without resort to removing the upper mattress.

7 Claims, 8 Drawing Figures

DUST RUFFLE

The subject invention relates to a new and improved dust ruffle for a bed. Although the invention will be described and illustrated with respect to a conventional bed of rectangular configuration, it is readily apparent that the subject invention is also applicable to beds of different configurations, such as round.

Heretofore, dust ruffles have been of relatively simple construction and have merely comprised a sheet material adapted to be positioned between the upper and lower mattresses of a bed, completely covering the upper surface of the lower mattress, and having a depending portion extending to the floor in order to prevent the accumulation of dust under the bed, as well as for esthetic reasons. In order to remove and replace the conventional dust ruffle, it was necessary for the housekeeper to lift the upper mattress off the bed, replace the dust ruffle, and then again lift the mattress and position it carefully on the bed so as to prevent the dust ruffle from being moved out of position. As is apparent, considering the weight of mattresses, this is an extremely difficult, heavy, and burdensome task.

It is the primary object of the subject invention to overcome the shortcomings of the prior art, and more particularly provide a dust ruffle which may readily be removed and replaced without resort to physically removing the upper mattress of the bed.

It is a further object of the subject invention to provide a dust ruffle which may be readily and rapidly removed and replaced on a bed, and when in position it inherently remains in place, even though the mattress may be slightly shifted.

These and other objects and advantages are achieved by the subject invention which provides a dust ruffle that may be removably positioned on a bed including an upper mattress, and a lower box spring mattress, and comprising an elastic partial platform portion which is adapted to be disposed between the upper and lower mattresses. The elastic partial platform may be expanded to a size corresponding to the plan form of the upper mattress in order to enable the dust ruffle to be readily slipped over the upper mattress to a position for insertion between the upper and lower mattresses. When the elastic portion of the partial platform is in its relaxed position, the partial platform portion partially covers the plan form of the lower mattress. Depending from said elastic partial platform portion is a continuous side portion of the dust ruffle which is adapted to cover the sides of the lower mattress, and in turn, a dust ruffle portion depends from said continuous side portion for a sufficient length to form a dust ruffle preventing and inhibiting dust from accumulating below the bed.

It is a further object of the invention to provide a dust ruffle described above wherein the partial platform portion is completely formed of elastic material, and in a further embodiment the elastic partial platform portion includes mitered corners. Still further, the dust ruffle may be formed with the elastic partial platform portion including L-shaped elastic corners interconnected by non-elastic fabric material portion.

In further modification of the invention, the width of the upper portion of the elastic platform portion may be uniform, and in a further embodiment the continuous side portion of the dust ruffle may be made of an elastic fabric material.

It is a further object to provide a dust ruffle as described above wherein the continuous side portion is made of non-stretcheable fabric material, or an embodiment where the dust ruffle portion extends on only three sides of the lower mattress.

In a further embodiment, the dust ruffle portion extends about four sides of the lower mattress.

In another embodiment of the invention there is provided a dust ruffle including a partial platform portion, a side portion extending about the sides of the box spring mattress, and a dust ruffle portion, with a split being provided in said portions to enable the dust ruffle to be removed and replaced on the bed without removing the upper mattress.

Further details relative to the construction of applicant's invention, and the objects and advantages thereof will become apparent from a reading of the following detailed description taken in conjunction with the drawings in which.

Figure 1:
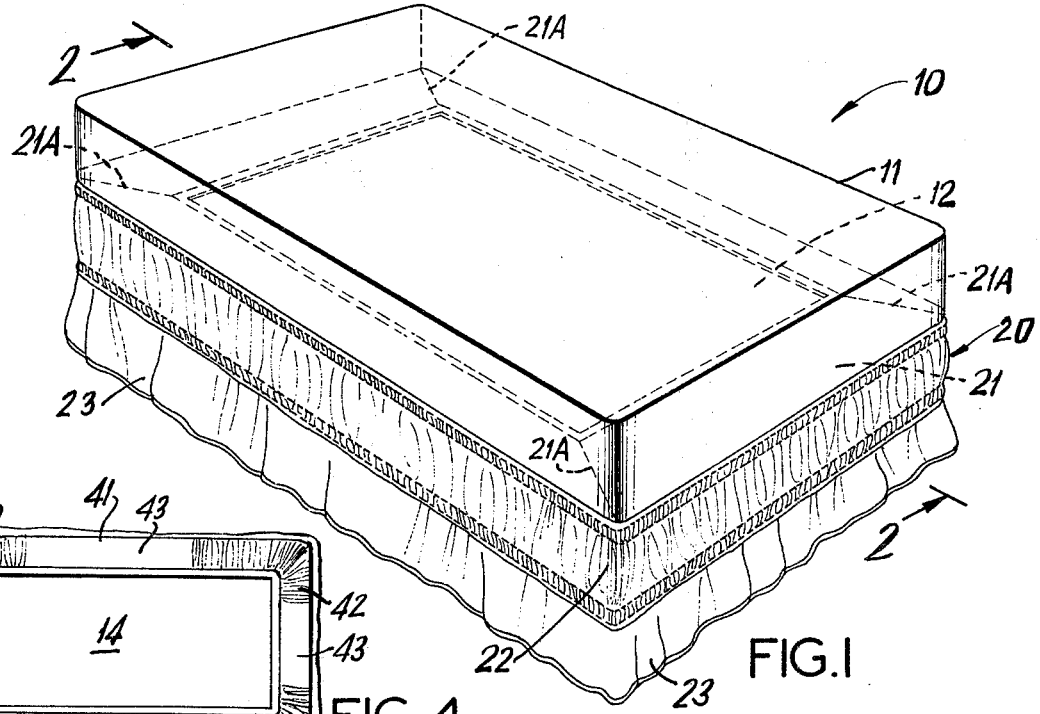
FIG. 1 is a perspective view of a bed including a first embodiment of a dust ruffle made according to the subject invention.
Figure 2:
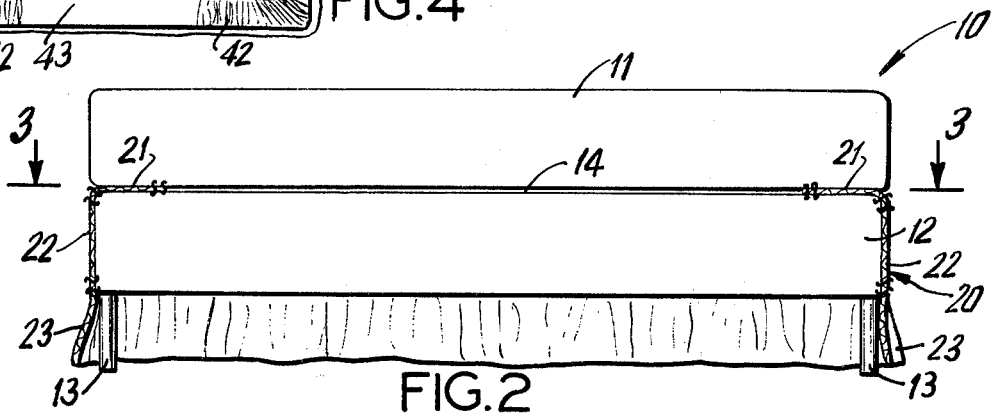
FIG. 2 is a sectional view taken along line 2—2 in FIG. 1.
Figure 3:
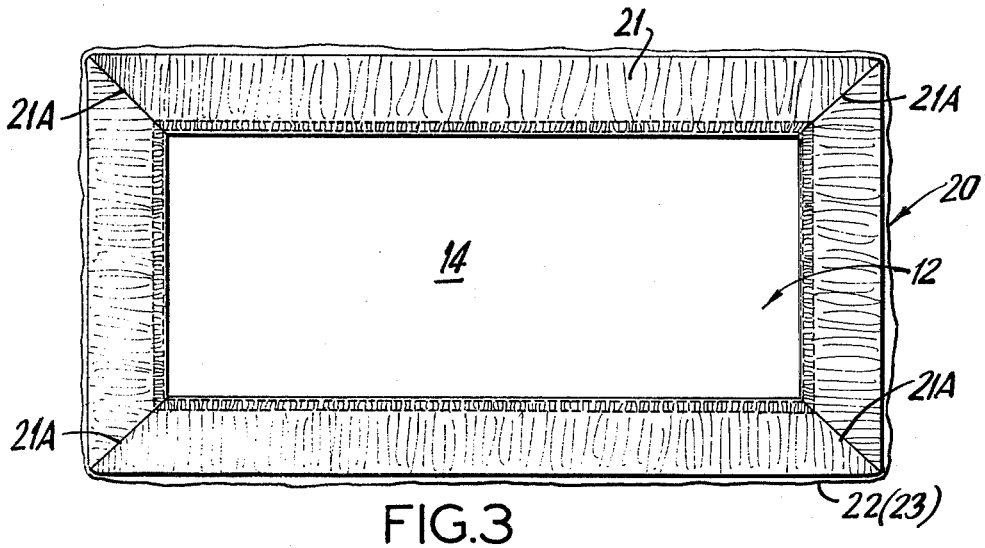
FIG. 3 is a plan view taken along line 3—3 in FIG. 2.
Figure 5:
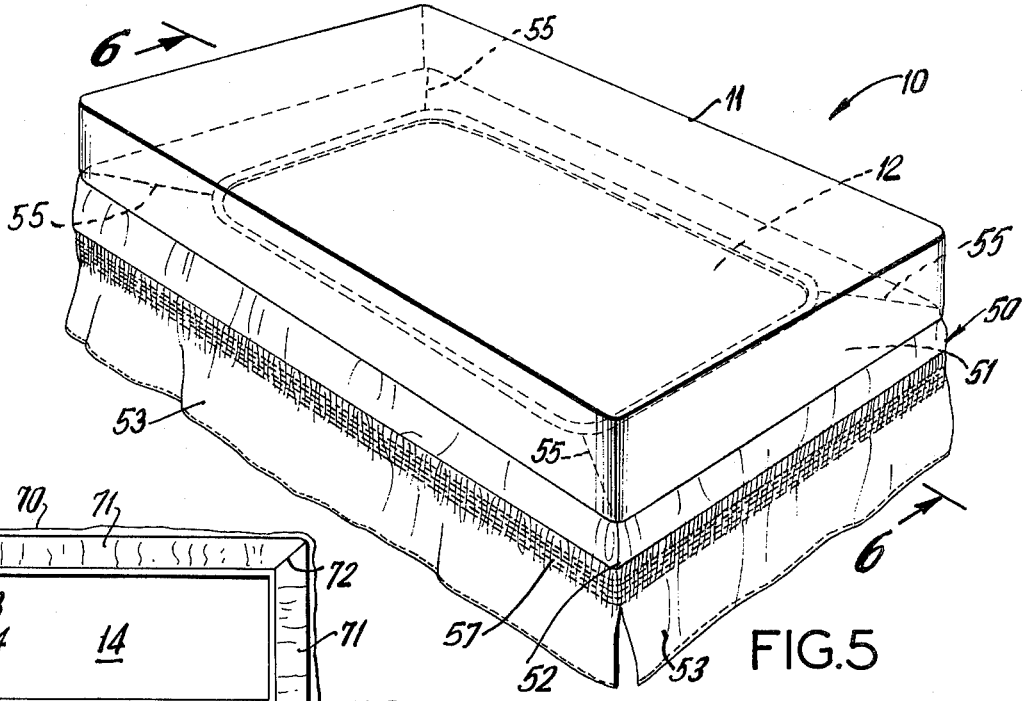
FIG. 5 is a perspective view of a bed having a third embodiment of a dust ruffle made according to the subject invention.
Figure 6:
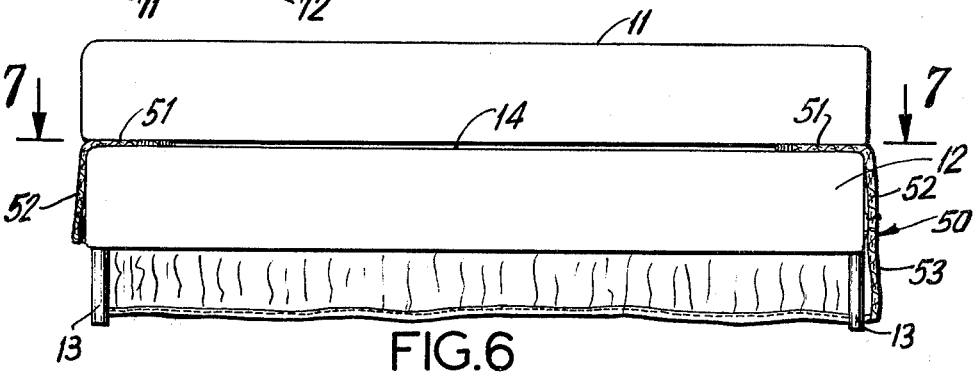
FIG. 6 is a sectional view taken along line 6—6 in FIG. 5.
Figure 7:
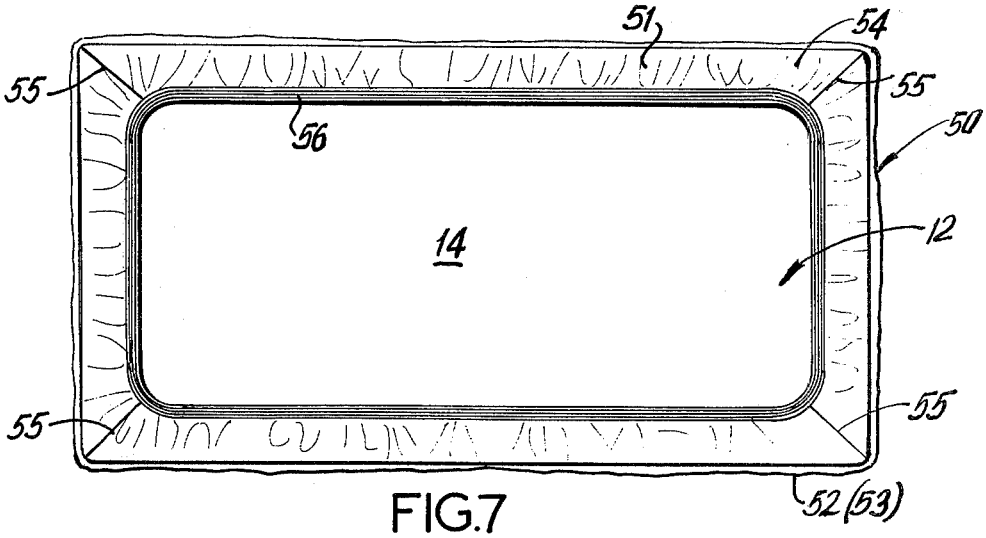
FIG. 7 is a plan view taken along line 7—7 in FIG. 6.

Referring to FIGS. 1 to 3 which illustrate a first embodiment of the subject dust ruffle, a bed is designated by the numeral 10 and includes an upper mattress 11 and a lower box spring mattress 12 supported above the floor by means of frame 13. The dust ruffle 20 of the first embodiment basically comprises an elastic partial platform portion 21, a continuous side portion 22, and a dust ruffle portion 23. The elastic partial platform portion 21 is adapted to be disposed between the upper mattress 11 and the lower mattress 12, and is elastically held in place as well as frictionally held in place by the weight of the upper mattress. The portion 21 partially covers the top platform 14 of the lower mattress 12. In the first embodiment, the elastic partial platform portion 21 is formed of an all elastic material, preferably a fabric material, and includes mitered corners 21A. In order to enable the dust ruffle 20 to be placed on the bed 10 between the upper mattress 11 and the lower mattress 12, without removing the upper mattress 11, the elastic partial platform portion 21 may be stretched or expanded to a size greater than the plan form of the upper mattress 11 so as to enable the dust ruffle and portion 21 to be slipped over the upper mattress and then between the upper and lower mattresses to the final position indicated in FIGS. 1 through 3. The continuous side portion 22 may be made of an all elastic material, as illustrated in FIG. 1, or may be formed of a fabric material of a size to conform to the outer peripheral contour of the lower mattress 12. The dust ruffle portion 23 may be made of any suitable material providing the desired esthetic effect, as well as the desired functional aspect of assuring the prevention of the accumulation of dust beneath the bed. In addition, the dust ruffle portion 23 may extend around three sides of the mattress 12 (as shown in the embodiment of FIGS. 5 to 7), or about all four sides of the mattress, as shown in the embodiment in FIGS. 1 through 3.

Referring to FIG. 3, it is noted that preferably the width of the elastic partial platform portion 21 is uniform about the periphery of the lower mattress 12, and is of sufficient width to insure that it is frictionally retained in place by the weight of the upper mattress bearing against the partial platform portion 21. As contrasted to conventional dust ruffle covers, it is noted that less material is required in the subject dust ruffle 20 in that it only partially covers the upper platform 14 of the lower mattress 12, whereas conventional dust ruffles generally cover the entire top platform 14.

As is readily apparent, in use, it is merely necessary for the housekeeper to reach between the mattresses and expand the elastic partial platform portion to a sufficient width to enable the dust ruffle to be removed by passage over the upper mattress 11. In like manner, it is readily simple for the housekeeper to replace the dust ruffle 20 by merely expanding the elastic partial platform portion 21 over the upper mattress 11, and thence between the upper and lower mattresses to the final position indicated in FIG. 1. There is no need to undertake the lifting of the heavy upper mattress 11 in order to remove and replace the subject dust ruffle 20.

Figure 4:
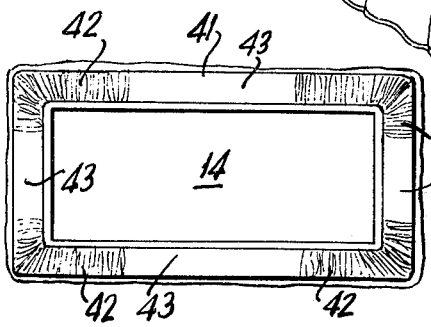
FIG. 4 is a plan view of a lower box spring mattress covered with a second embodiment of a dust ruffle made according to the subject invention.

FIG. 4 illustrates an alternate embodiment of subject invention wherein the elastic partial platform portion 41 is formed by four L-shaped elastic corner portions 42 interconnecting four non-stretchable fabric portions 43. It is not necessary to have mitered corners in the L-shaped elastic corners 42. As in the first embodiment, the dust ruffle illustrated in FIG. 4 also includes a continuous side portion and a depending dust ruffle portion.

FIGS. 5 through 7 illustrate another embodiment of the subject invention which is more economical to manufacture. Dust ruffle 50 includes partial platform portion 51, continuous side portion 52, and dust ruffle portion 53. The elastic partial platform portion 51 is formed by means of a shirred fabric 54 including mitered corners 55, and a continuous elastic strip 56 which may be expanded to a sufficient degree in order to enable the dust ruffle 51 to be passed over the upper mattress 11 for removal and replacement. The amount of shirring of the material 54 is sufficient to insure that the material expands to a greater plan size than the mattress 11. The continuous side portion 52 may be formed of a similar size material including an elastic band 57 to aid in maintaining the dust ruffle 50 in position, and as previously indicated, the dust ruffle portion 53 may be formed on only three sides of the lower mattress 12.

Figure 8:
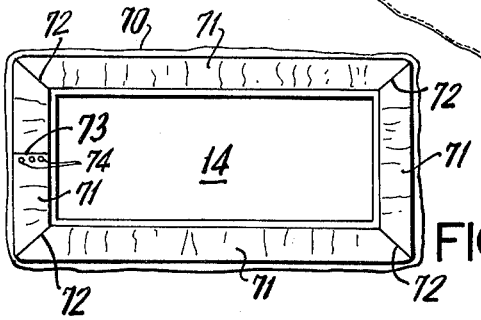
FIG. 8 is a plan view of a lower box spring mattress covered with a fourth embodiment of the subject invention.

FIG. 8 illustrates still another embodiment of the invention wherein the upper partial platform portion 70 of the dust ruffle includes non-elastic panels 71 joined at mitered corners 72. The side portion of the dust ruffle extends about all four sides of the lower mattress, whereas the dust ruffle portion may alternatively extend about three or four sides thereof. Both the partial platform portion and the side portion (as well as the dust ruffle portion if a four sided dust ruffle portion is provided) are split as at 73 in order to enable the housekeeper to remove and replace the dust ruffle by merely sliding the partial platform portion between the mattresses without physically removing the upper mattress. Suitable fastening means 74 may be provided to hold the split portions together, and may take the form of snaps, ties, zippers, buttons, hook and eyes, etc.

Accordingly there is provided a new and improved dust ruffle to be removably positioned on a bed, and being of a construction to enable the dust ruffle to be placed on and removed from the bed without resort to removal of the upper mattress. The partial platform portion enables the ready removal and replacement of the dust ruffle, and by being partly disposed between the upper and lower mattresses, the weight of the upper mattress aids in maintaining the dust ruffle in position.

It will thus be seen that the objects set forth above are effectively obtained, and certain changes may be made in the above construction without departing from the spirit and scope of the invention, and it is intended that matter contained in the above description and shown in the accompanying drawings shall be interpreted as illustrative only and not in a limiting sense.

What is claimed is:

1. A dust ruffle to be removably positioned on a bed including upper and lower mattresses comprising:

an elastic partial platform portion to be disposed between said upper and lower mattresses, said elastic partial platform portion being formed by a continuous peripheral elastic member which defines a central opening in the dust ruffle, said peripheral elastic member being expandable to enlarge said opening to a size corresponding to the plan form of the upper mattress to enable complete passage of said dust ruffle over said upper mattress for positioning, in its relaxed position, to partially cover the plan form of said lower mattress;

a continuous side portion connected to said partial platform portion and adapted to cover the sides of said lower mattress; and a dust ruffle portion depending from said continuous side portion.

2. A dust ruffle according to claim 1 wherein said elastic partial platform portion includes mitered corners.

3. A dust ruffle according to claim 1 wherein said elastic partial platform portion includes L-shaped elastic corners interconnected by non-elastic fabric material portions.

4. A dust ruffle according to claim 1 wherein the width of the upper portion of said partial platform portion is uniform.

5. A dust ruffle according to claim 1 wherein said dust ruffle portion extends along only three sides of said lower mattress.

6. A dust ruffle according to claim 1 wherein said dust ruffle portion extends about four sides of said lower mattress.

7. A dust ruffle according to claim 1 wherein said partial platform portion and said side portion are split, and wherein fastening means are provided to secure said split portions.

* * * * *